US007140430B2

(12) United States Patent
Wubben

(10) Patent No.: US 7,140,430 B2
(45) Date of Patent: Nov. 28, 2006

(54) EXPANDER FOR EXPANDING A TUBULAR ELEMENT

(75) Inventor: Antonius Leonardus Maria Wubben, Rijswijk (NL)

(73) Assignee: Shell Oil Company, Houston, TX (US)

( * ) Notice: Subject to any disclaimer, the term of this patent is extended or adjusted under 35 U.S.C. 154(b) by 193 days.

(21) Appl. No.: 10/484,288

(22) PCT Filed: Jul. 19, 2002

(86) PCT No.: PCT/EP02/08139

§ 371 (c)(1),
(2), (4) Date: Jan. 20, 2004

(87) PCT Pub. No.: WO03/010414

PCT Pub. Date: Feb. 6, 2003

(65) Prior Publication Data

US 2004/0177953 A1 Sep. 16, 2004

(30) Foreign Application Priority Data

Jul. 20, 2001 (EP) ..... 01306278

(51) Int. Cl.
*E21B 23/00* (2006.01)

(52) U.S. Cl. ..... 166/207; 166/217

(58) Field of Classification Search ..... 166/206, 166/207, 217

See application file for complete search history.

(56) References Cited

U.S. PATENT DOCUMENTS 4,483,399 A 11/1984 Colgate
6,012,523 A 1/2000 Campbell et al.
6,325,148 B1 * 12/2001 Trahan et al. ..... 166/297
6,354,372 B1 * 3/2002 Carisella et al. ..... 166/118
6,454,493 B1 * 9/2002 Lohbeck ..... 405/184.2
2005/0173129 A1 * 8/2005 Oosterling et al. ..... 166/382

FOREIGN PATENT DOCUMENTS

EP 0 386 895 9/1990
EP 0 957 233 A2 11/1999
WO 00/26500 5/2000

OTHER PUBLICATIONS

International Search Report dated Oct. 23, 2002.
Office Action dated Apr. 15, 2005, U.S. Appl. No. 10/471,778, Lohbeck.

(Continued)

*Primary Examiner*—William Neuder
*Assistant Examiner*—Nicole A Coy
(74) *Attorney, Agent, or Firm*—Rachael A. Stiegel

(57) ABSTRACT

An expander for radially expanding a tubular element, comprising an expander body connectable to an elongate member for moving the expander in axial direction through the tubular element, the expander body having a first body portion and a second body portion axially displaced from the first body portion, wherein the first body portion has a larger outer diameter than the second body portion. A set of expander segments is arranged around the expander body, each segment being movable relative the expander body between a radically extended position in which the segment is axially aligned with the first body portion and a radially retracted position in which the segment is axially aligned with the second body portion. Actuating means is provided for moving each segment between the extended position and the retracted position. Each segment and the first body portion are provided with co-operating support profiles for preventing axial movement of the segment relative to the first body portion during expansion of the tubular element whereby the segment is in the extended position.

8 Claims, 4 Drawing Sheets

OTHER PUBLICATIONS

Office Action dated Oct. 11, 2005, U.S. Appl. No. 10/795,951, Campo.
Office Action dated Jun. 16, 2005, U.S. Appl. No. 10/795,951, Campo.
Office Action dated Oct. 11, 2005, U.S. Appl. No. 10/795,841, Campo.
Office Action dated Jun. 16, 2005, U.S. Appl. No. 10/795,841, Campo.
Office Action dated Oct. 5, 2005, U.S. Appl. No. 10/795,894, Campo.
Office Action dated Oct. 11, 2005, U.S. Appl. No. 10/795,894, Campo.
Office Action dated Oct. 4, 2005, U.S. Appl. No. 10/796,664, Campo.
Office Action dated Oct. 11, 2005, U.S. Appl. No. 10/796,664, Campo.

* cited by examiner

Fig.2.A.

EXPANDER FOR EXPANDING A TUBULAR ELEMENT

FIELD OF THE INVENTION

The present invention relates to an expander for radially expanding a tubular element.

BACKGROUND OF THE INVENTION

In the industry of hydrocarbon oil and gas production it has been proposed to radially expand a tubular element extending in a wellbore formed into an earth formation. The tubular element can be, for example, a wellbore casing which is, after expansion thereof, cemented in the wellbore. In conventional wellbore drilling the wellbore is drilled and cased in sections whereby after drilling and casing each section, the wellbore is drilled deeper and a next casing section is lowered through the previous casing section. Thus, the next casing section necessarily has to be of smaller outer diameter than the inner diameter of the previous casing section. By radially expanding each casing section after installation thereof in the wellbore, it is achieved that the lower wellbore part still is of a sufficiently large diameter.

It has been proposed to expand each casing section by pulling, pushing or pumping a rigid expander through the casing section whereby the expander has an outer diameter larger than the inner diameter of the unexpanded casing. By virtue of the phenomenon that the inner diameter of the casing after expansion is slightly larger than the outer diameter of the expander (generally referred to as "surplus expansion"), the expander can be moved through expanded casing portions with some clearance. However, a problem of the known expander is that it is impossible to move the expander through unexpanded portions of the casing.

It has further been proposed to apply a collapsible expander which can be moved through the casing when in the collapsed position. One such collapsible expander is disclosed in U.S. Pat. No. 6,012,523, which expander is provided with hingeable segments (also termed fingers) which axially slide over a conically shaped body portion to form the final expanded cone. A drawback of this expander is that the hinges of the segments are subjected to high (friction) loads during the expansion process. Another drawback of the expander is that small clearances between the segments cause extrusion of the tubular element into such clearances thereby causing axial tracks on the inside of the expanded tube, which tracks form insufficiently expanded portions at the inner surface of the tubular element.

Accordingly there is a need for an improved expander which overcomes the aforementioned drawbacks.

SUMMARY OF THE INVENTION

In accordance with a first aspect of the invention there is provided an expander for radially expanding a tubular element, comprising an expander body connectable to an elongate member for moving the expander in axial direction through the tubular element, the expander body having a first body portion and a second body portion axially displaced from the first body portion, wherein the first body portion has a larger outer diameter than the second body portion;

a set of expander segments arranged around the expander body, each segment being movable relative the expander body between a radially extended position in which the segment is axially aligned with the first body portion and a radially retracted position in which the segment is axially aligned with the second body portion; and actuating means for moving each segment between the extended position and the retracted position;

wherein the segment and the first body portion are provided with co-operating support profiles for preventing axial movement of the segment relative to the first body portion during expansion of the tubular element whereby the segment is in the extended position.

It is thereby achieved that the co-operating support profiles transfer the axial friction forces acting on each segment to the expander body, so that the actuating means (e.g. a hinge or a leaf spring) of the segment is relieved from transfer of the high friction forces.

In another aspect of the invention there is provided an expander for radially expanding a tubular element, comprising an expander body connectable to an elongate member for moving the expander in axial direction through the tubular element, the expander body having a first body portion and a second body portion axially displaced from the first body portion, wherein the first body portion has a larger outer diameter than the second body portion;

a set of expander segments arranged around the expander body, each segment being movable relative the expander body between a radially extended position in which the segment is axially aligned with the first body portion and a radially-retracted position in which the segment is axially aligned with the second body portion; and actuating means for moving each segment between the extended position and the retracted position thereof;

wherein the expander segments when in their respective radially extended positions, form a substantially continuous cone surface, and wherein each pair of adjacent segments have a common boundary line along the cone surface, said boundary line extending inclined relative to the longitudinal axis of the expander.

By the arrangement that the common boundary line, which represents a small clearance between adjacent segments, extends inclined relative the longitudinal axis, it is achieved that the expander moves against the full inner surface of the tubular element.

BRIEF DESCRIPTION OF THE DRAWINGS

The invention will be described hereinafter in more detail and by way of example with reference to the accompanying drawings in which:

FIG. 2A schematically shows a side view, partly in longitudinal section, of the expander of FIG. 1, when in a radially expanded mode;

DETAILED DESCRIPTION OF THE INVENTION

Figure 1:
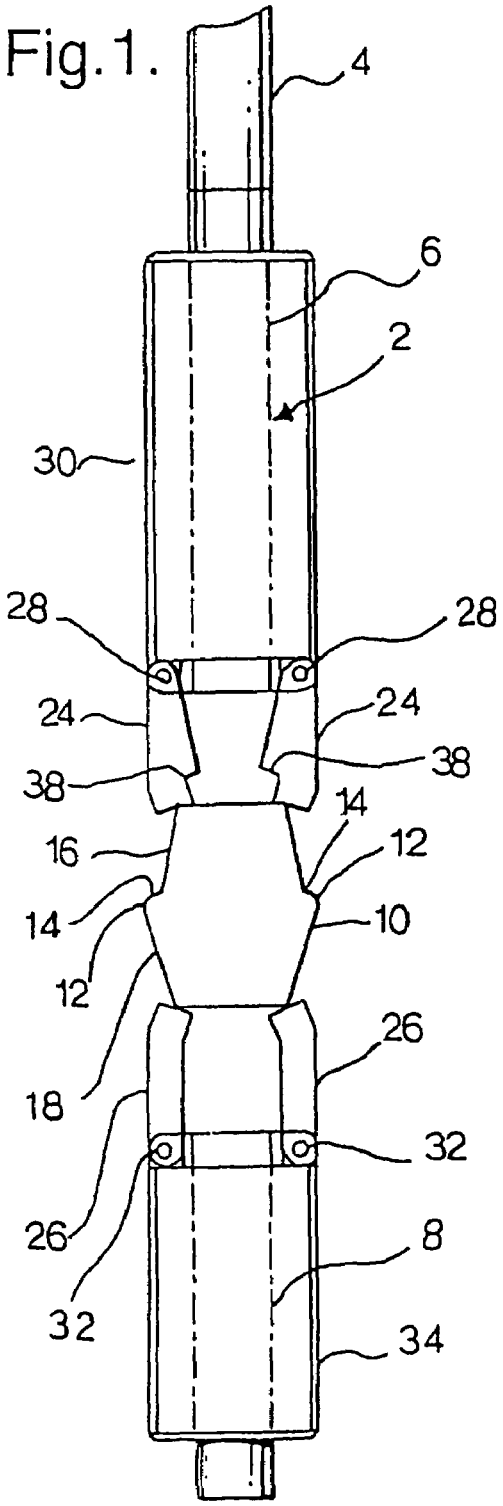
FIG. 1 schematically shows a side view, partly in longitudinal section, of first embodiment of an expander of the invention, when in a radially unexpanded mode.
Figure 1:
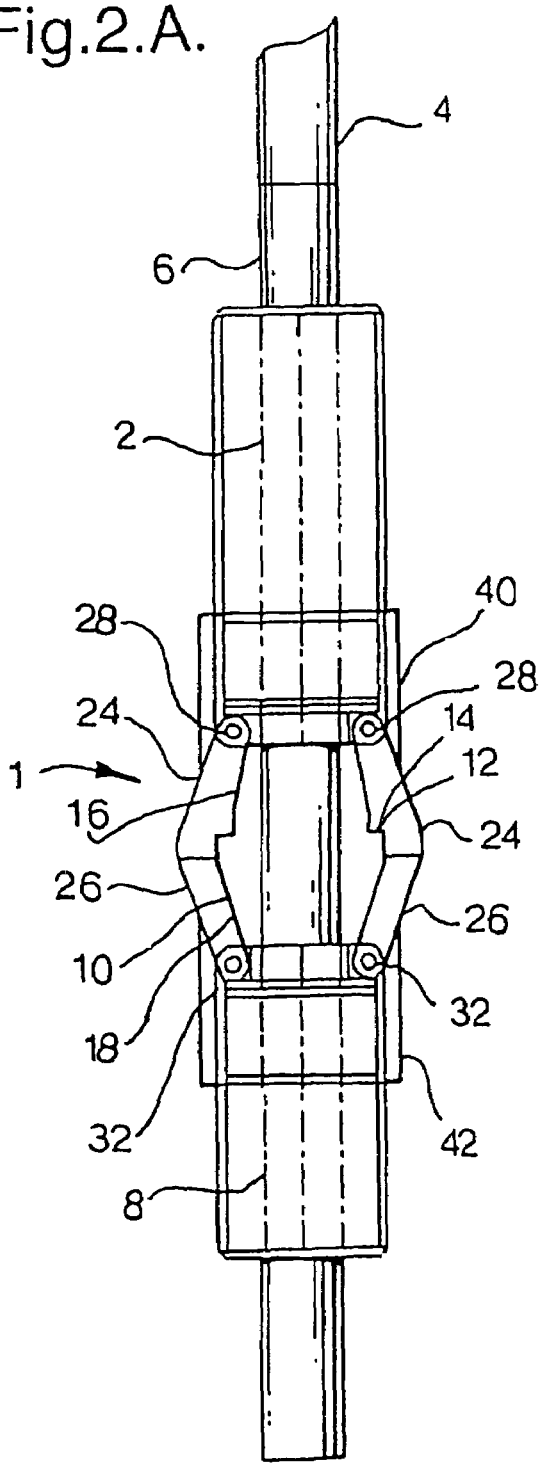

Referring to FIG. 1 there is shown a first embodiment of an expander 1 for radially expanding a tubular element (not shown) such as a casing extending in a wellbore. The expander 1 includes an elongate expander body 2 connected to a pulling string 4 for pulling the expander 1 through the casing. The expander body 2 has two small diameter portions 6, 8 and a large diameter portion 10 arranged inbetween the small diameter portions 6, 8. The large diameter portion 10 is provided with an annular support edge 12 defining an annular support surface 14 (i.e. an annular shoulder) extending substantially in radial direction, which support edge 12 is located about centrally of the axial length of the large diameter portion 10. Furthermore, the large diameter body portion 10 has a first frustoconical surface 16 tapering down from the support edge 12 to the small diameter portion 6, and a second frustoconical surface 18 tapering down from the support edge 12 to the small diameter portion 8.

The expander 1 further comprises a plurality of expander segments of which a set of primary segments 24 is arranged around the small diameter portion 6 of body 2, and of which a set of secondary segments 26 is arranged around the small diameter portion 8 of body 2. Each primary segment 24 is connected by a respective hinge 28 to a primary actuating sleeve 30 surrounding the small diameter portion 6, and each secondary segment 26 is connected by a respective hinge 32 to a secondary actuating sleeve 34 surrounding the small diameter portion 8. The respective assemblies of primary actuating sleeve 30 and primary segments 24, and secondary actuating sleeve 34 and secondary segments 26, are axially movable relative to the expander body 2 whereby during movement of the primary segments 24 along the first frustoconical surface 16 the segments 24 hinge relative to the primary actuating sleeve 30, and whereby during movement of the secondary segments 26 along the second frustoconical surface 18 the segments 26 hinge relative to the secondary actuating sleeve 34. Each primary segment 24 has at its inner surface a support profile 38 which is complementary in shape to the support edge 12 so that, when the assembly of primary actuating sleeve 30 and primary segments 24 is fully moved against the large diameter body portion 10, said support profile 38 is biased against the annular surface 14 of support edge 12.

Reference is further made to FIG. 2A, showing the expander 1 whereby both the primary segments 24 and the secondary segments 26 have been fully moved against the large diameter body portion 10. In this position the primary segments 24 and secondary segments 26 are hinged radially outward and rest against the respective first and second frustoconical surfaces 16, 18, whereby the support profile 38 of each primary segments 24 is biased against the annular surface 14 of support edge 12. Furthermore, in FIG. 2 is shown a primary locking sleeve 40 axially movable relative to the primary segments 24 between an unlocking position in which the locking sleeve 40 is arranged remote from the segments 24 and a locking position in which the sleeve 40 closely surrounds the segments 24, and a secondary locking sleeve 42 axially movable relative to the secondary segments 26 between an unlocking position in which the locking sleeve 42 is arranged remote from the segments 26 and a locking position in which the sleeve 42 closely surrounds the segments 26.

Figure 2B:
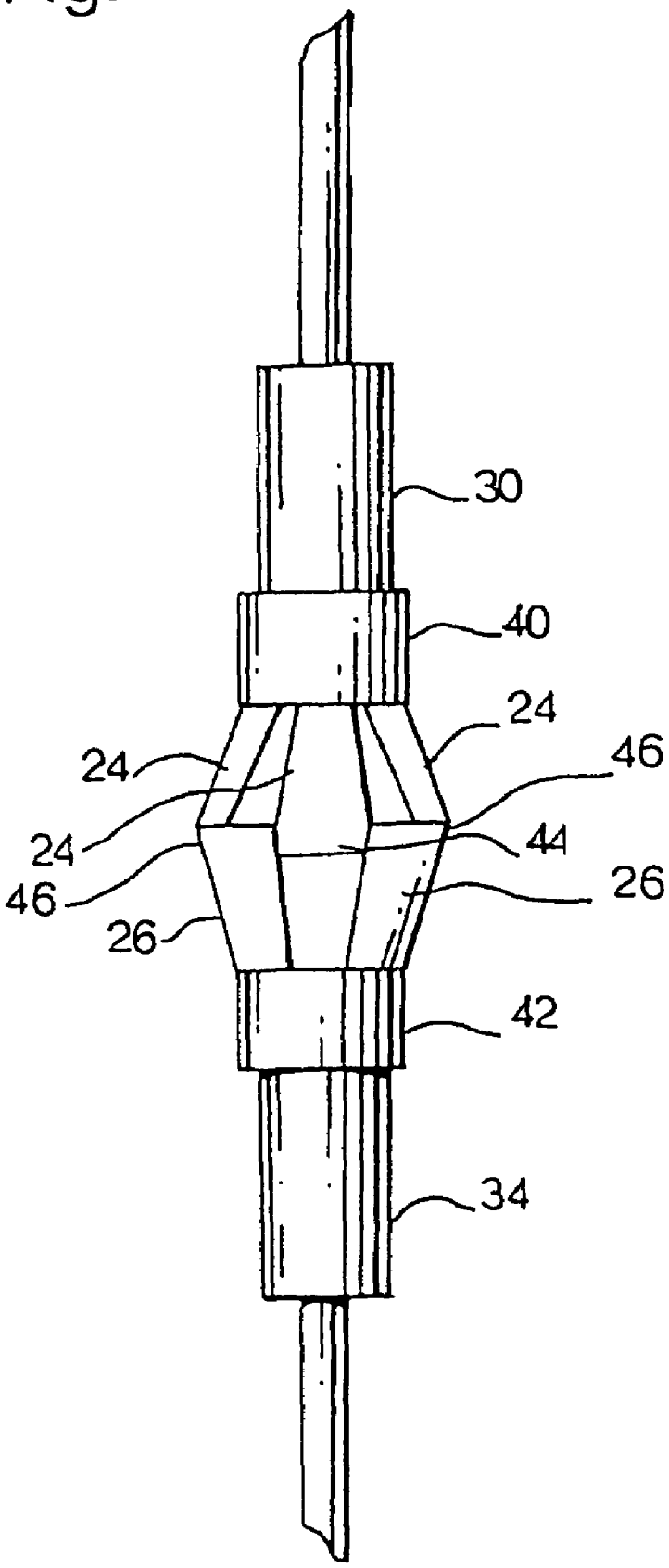
FIG. 2B schematically shows a side view of the expander of FIG. 1, when in a radially expanded mode.

In FIG. 2B is shown a side view of the expander 1 with the segments 24, 26 in the radially expanded position. As shown, the primary segments 24 and the secondary segments 26 have respective axially overlapping portions 44, 46 which are staggeredly arranged when seen in circumferential direction.

Figure 3:
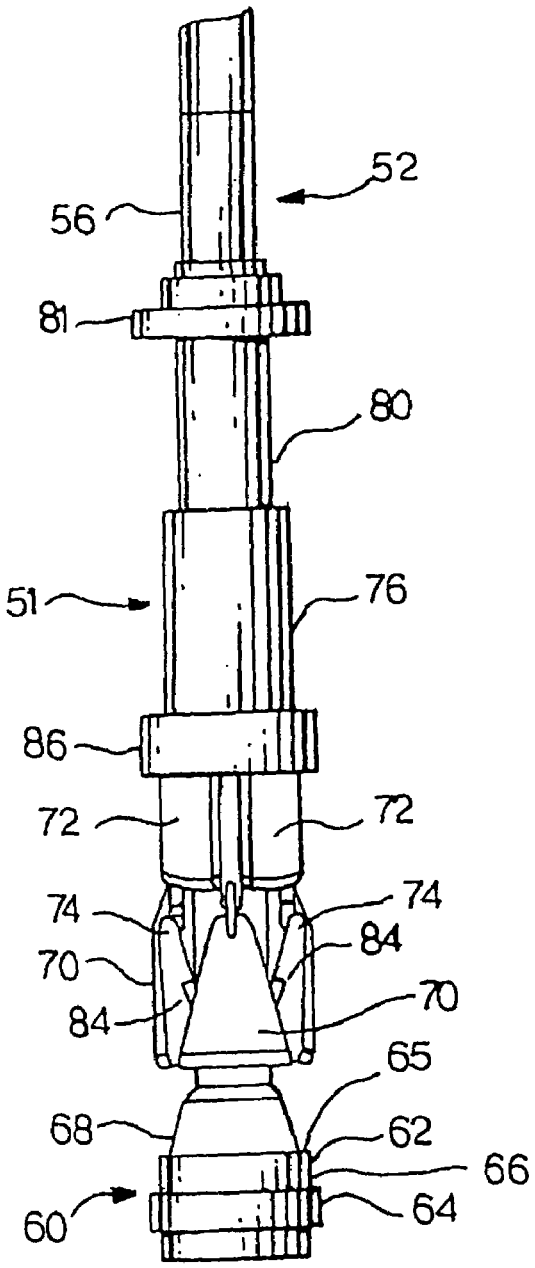
FIG. 3 schematically shows a side view of a second embodiment of an expander of the invention, when in a radially unexpanded mode.

In FIG. 3 is shown a second embodiment of an expander 51 for radially expanding a tubular element (not shown) such as a casing extending in a wellbore. The expander 51 includes an elongate expander body 52 connected to a pulling string 54 for pulling the expander 50 through the casing. The expander body 52 has a small diameter portion 56 and a large diameter portion 60 arranged at one end of the small diameter body portion 56. The large diameter portion 60 is provided with two annular support edges 62, 64 defining respective annular support surface 65, 66, each extending substantially in radial direction. The large diameter body portion 60 has a frustoconical surface 68 tapering down from the support edge 62 to the small diameter portion 56.

The expander 51 is provided with a plurality of expander segments including a set of primary segments 70 and a set of secondary segments 72, both sets being arranged around the small diameter body portion 56 whereby the secondary segments 72 are arranged axially remote from the large diameter body portion 60 and the primary segments 70 are arranged between the set of secondary segments 72 and the large diameter body portion 60. The primary segments 70 and secondary segments 72 are staggeredly arranged when seen in circumferential direction. Furthermore, the width of each primary segment 70 increases in axial direction away from the pulling string 54, and the width of each secondary segment is substantially constant in axial direction.

Each primary segment 70 is connected by a respective hinge 74 (or a leaf spring) to a primary actuating sleeve 76, and each secondary segment 72 is connected by a respective hinge or leaf spring (not shown) to a secondary actuating sleeve 80. The actuating sleeves 76, 80 are arranged concentrically around the small diameter body portion 56 whereby primary actuating sleeve 76 extends around secondary actuating sleeve 80. The secondary actuating sleeve 80 is provided with a top ring 81.

The respective assemblies of primary actuating sleeve 76 and primary segments 70, and secondary actuating sleeve 80 and secondary segments 72, are axially movable relative to each other and relative to the expander body 52. During movement of the segments 70, 72 along the frustoconical surface 68 the primary segments 70 hinge relative to the primary actuating sleeve 76 and the secondary segments 72 hinge relative to the secondary actuating sleeve 80. Each segment 70, 72 has at its inner surface a support profile 84 which is complementary in shape to the support edges 62, 64 so that, when the primary segments 70 and secondary segments 72 are fully moved against the large diameter body portion 60, the support profile 84 of each segment is in abutment with the annular support surfaces 65, 66.

A locking sleeve 86 arranged around the set of secondary segments 72, is axially movable between an unlocking position in which the locking sleeve 86 is axially displaced from the primary segments 70 when these are axially displaced from the large diameter body portion 60, and a locking position in which the locking sleeve 86 closely surrounds the segments 70, 72 when these are biased against the large diameter body portion 60.

Figure 4:
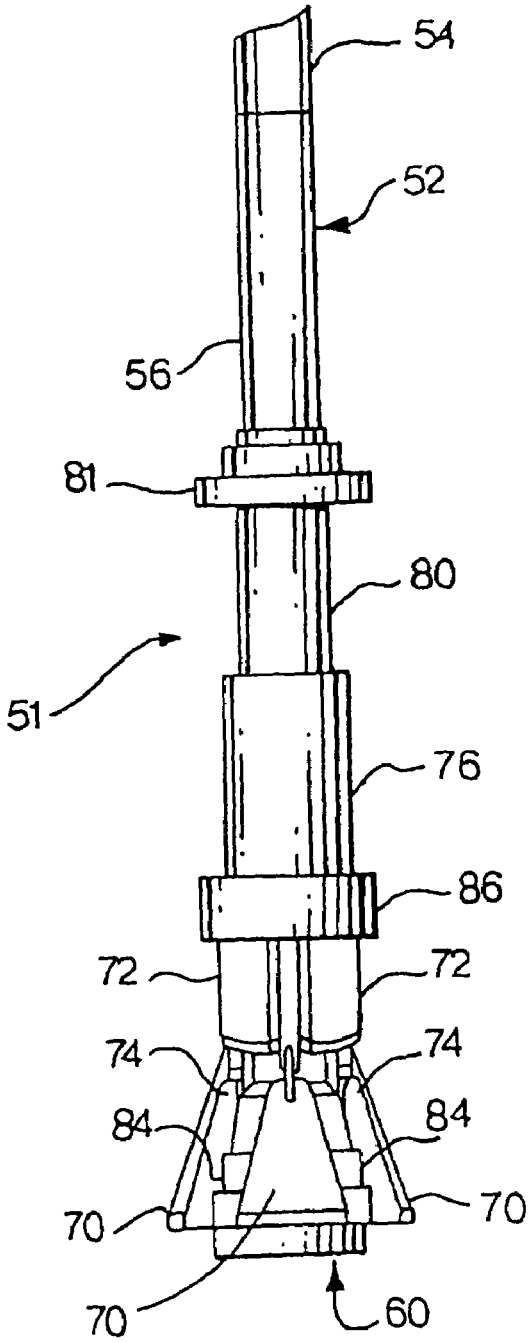
FIG. 4 schematically shows a side view of the expander of FIG. 3, when partially radially expanded.

In FIG. 4 is shown the expander 51 whereby the respective assemblies of primary actuating sleeve 76 and primary segments 70, and secondary actuating sleeve 80 and secondary segments 72, have been moved towards the large diameter body portion 60 whereby the primary segments 70 are biased against the large diameter body portion 60.

Figure 5:
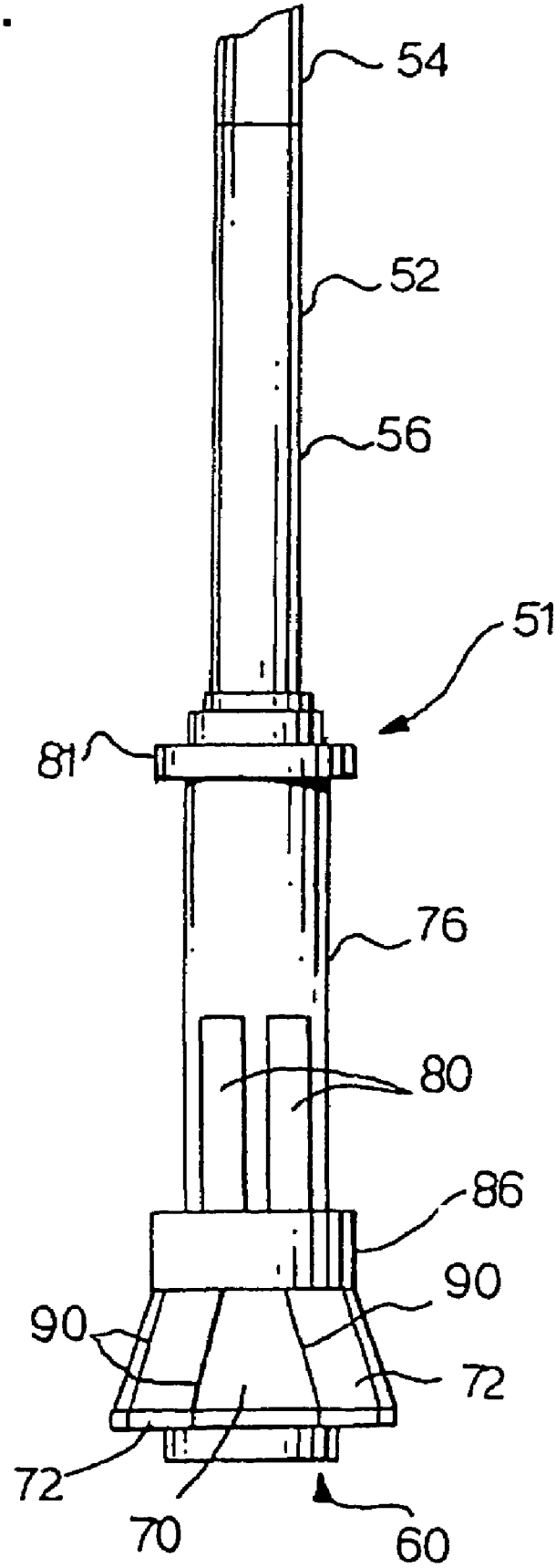
FIG. 5 schematically shows a side view of the expander of FIG. 3, when fully radially expanded.

In FIG. 5 is shown the expander 51 whereby the respective assemblies of primary actuating sleeve 76 and primary segments 70, and secondary actuating sleeve 80 and secondary segments 72, have been further moved towards the large diameter body portion 60 whereby both sets of primary segments 70 and secondary segments 72 are biased against the large diameter body portion 60. As illustrated in FIG. 5, the expander segments 70, 72 when biased against the large diameter body portion 60, form a substantially continuous cone surface whereby for each pair of adjacent segments 70, 72 there is defined a common boundary line 90 (representing a small clearance between the adjacent segments) along the cone surface, which boundary line extends inclined relative to the longitudinal axis of the expander 51.

During normal operation of the first embodiment, the expander 1 is lowered into the wellbore casing to be expanded at pulling string 4, whereby the expander 1 is in the unexpanded mode shown in FIG. 1. When the expander has reached the lower end of the casing, the actuating sleeves 30, 34 are axially moved towards the large diameter body portion 10 by a suitable actuating device (not shown). By virtue of the movement of sleeve 30, the primary segments 24 move along the first frustoconical surface 16 until the support profile 38 become biased against the annular support surface 14. By virtue of the movement of the sleeve 34, the secondary segments 24 move along the second frustoconical surface 18 until the secondary segments 24 abut against the second frustoconical surface 18. It has thus been achieved that the primary and secondary segments have hinged radially outwardly, as shown in FIGS. 2A and 2B. The locking sleeves 40, 42 are then moved to their respective locking positions (as shown in FIGS. 2A, 2B).

The expander 1 is then pulled through the casing by means of pulling string 4 so as to radially expand the casing in the wellbore. During the expansion process, the segments 24, 26 are subjected to friction forces from the inner surface of the casing, whereby especially the primary segments 24 are subjected to high friction forces. For each primary segment, the friction forces are transmitted via the support profile 38 to the annular support surface 14 of the large diameter body portion 10. It is thereby achieved that the hinges 28 (or leaf springs) are not subjected to the high friction forces, and the risk of damage to the hinges 28 has thereby been considerably reduced. Furthermore, it is achieved that the locking sleeves 40, 42 keep the respective sets of primary secondary segments closely biased against the large diameter body portion 10 and thereby assist in reducing transfer of friction forces to the hinges 28, 32 or leaf springs.

When the casing has been fully expanded, the expander 1 is removed from the casing and brought back to its unexpanded mode (as shown in FIG. 1) for future use.

During normal operation of the second embodiment, the expander 51 is lowered into the casing to be expanded at pulling string 54, whereby the expander 51 is in the unexpanded mode shown in FIG. 3. When the expander has reached the lower end of the casing, the actuating sleeves 76, 80 are simultaneously moved towards the large diameter body portion 60 by means of a suitable device (not shown) actuating the top ring 81. By virtue of the movement of primary actuating sleeve 76, each primary segment 70 moves along the frustoconical surface 68 until its support profile 84 becomes biased against the annular support surfaces 65, 66 (as shown in FIG. 4). From this position on, the primary actuating sleeve 76 is held stationary and the secondary actuating sleeve 80 is moved further towards large diameter portion 60 so that each secondary segment 72 moves along the frustoconical surface 68 until its support profile 84 becomes biased against the annular support surfaces 65, 66. It has thus been achieved that the primary and secondary segments 70, 72 have hinged radially outwardly so as to form the substantially continuous cone surface referred to hereinbefore. In a next step the locking sleeve 86 is axially moved against the segments 70, 72 so as to retain the segments closely against the large diameter body portion 60.

The expander 51 is then pulled through the casing by means of pulling string 54 so as to radially expand the casing in the wellbore. During the expansion process, the segments 70, 72 are subjected to friction forces from the inner surface of the casing, which forces act in the direction away from the pulling string 4. For each segment, the friction forces are transmitted via the support profile 84 to the annular support surfaces 65, 66 of the large diameter body portion 60. It is thereby achieved that the hinges (or leaf springs) of the segments 70, 72 are not subjected to the (high) friction forces, and the risk of damage to the hinges has thereby been considerably reduced. Furthermore, it is achieved that the locking sleeve 86 keeps the respective sets of primary secondary segments 70, 72 closely biased against the large diameter body portion 60 and thereby assist in reducing transfer of friction forces to the hinges. Another advantage of the second embodiment is that the cone surface formed by the combined segments 70, 72 moves along the entire inner surface of the casing by virtue of the feature that the small clearance between adjacent (represented by line 90 in FIG. 5) extends inclined relative to the longitudinal axis of the expander 51.

When the casing has been fully expanded, the expander 1 is removed from the casing and brought back to its unexpanded mode (as shown in FIG. 3) for future use.

Instead of pulling the expander through the casing, the expander can pumped or pushed through the casing.

In a modification of the first embodiment, each secondary segment has at its inner surface a support profile which co-operates with a support edge provided at the expander body in the same manner as the support profile/support edge system described with respect to each primary segment.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

I claim:

1. An expander for radially expanding a tubular element, comprising an expander body connectable to an elongate member for moving the expander in axial direction through the tubular element, the expander body having a first body portion and a second body portion axially displaced from the first body portion, wherein the first body portion has a larger outer diameter than the second body portion;

a set of expander segments arranged around the expander body, each segment being movable relative the expander body between a radially extended position in which the segment is axially aligned with the first body portion and a radially retracted position in which the segment is axially aligned with the second body portion; and actuating means for moving each segment between the extended position and the retracted position thereof;

wherein the expander segments when in their respective radially extended positions, form a substantially continuous cone surface, and wherein each pair of adjacent segments have a common boundary line along the cone surface, said boundary line extending inclined relative to a radial plane through the longitudinal axis of the expander.

2. The expander of claim 1, wherein the segments are arranged at one side of the first body portion and the segments include a set of primary segments and a set of secondary segments, and wherein the primary segments are located axially further away from the first body portion than the secondary segments when the segments are in their respective radially retracted positions.

3. The expander of claim 1, wherein the support profile of the first body portion is formed by an annular support edge provided at the first body portion, and wherein the support profile of the segment is formed by a complementary support edge provided at the segment.

4. The expander of claim 3, wherein the annular support edge of the first body portion extends substantially in radial direction or in at a small angle relative to the radial direction.

5. The expander of claim 3, wherein the annular support edge of the first body portion is defined by a support ring provided at the outer surface of the first body portion.

6. The expander of claim 1, wherein the actuating means includes an actuating member axially movable relative to the expander body, and wherein each segment is connected to the actuating member by means of a hinge or leaf spring allowing the segment to hinge between the retracted position and the expanded position.

7. The expander of claim 1, further comprising a locking sleeve axially movable relative to the segments when in their respective radially extended positions, between an unlocking position in which the locking sleeve is arranged remote from the segments and a locking position in which the sleeve surrounds the segments.

8. The expander of claim 1, wherein the primary segments and the secondary segments have respective axially overlapping portions which are staggeredly arranged.

* * * * *